US007563002B2

(12) United States Patent
Nabeshima

(10) Patent No.: US 7,563,002 B2
(45) Date of Patent: Jul. 21, 2009

(54) DISCHARGE LAMP WITH REFLECTOR

(75) Inventor: Takayuki Nabeshima, Yokohama (JP)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 288 days.

(21) Appl. No.: 11/372,338

(22) Filed: Mar. 9, 2006

(65) Prior Publication Data

US 2006/0203496 A1 Sep. 14, 2006

(30) Foreign Application Priority Data

Mar. 14, 2005 (JP) ..... 2005-070379

(51) Int. Cl.
*F21V 7/00* (2006.01)
*F21S 8/00* (2006.01)

(52) U.S. Cl. ..... 362/263; 362/267; 362/341; 362/296

(58) Field of Classification Search ..... 362/263, 362/267, 158, 538, 341, 296, 307
See application file for complete search history.

(56) References Cited

U.S. PATENT DOCUMENTS 4,520,432 A * 5/1985 Mayer et al. ..... 362/267
5,934,799 A * 8/1999 Suzuki et al. ..... 362/507
6,595,660 B2 7/2003 Spiro

FOREIGN PATENT DOCUMENTS

CN 1378234 A 11/2002
JP 2002-319310 A 10/2002

OTHER PUBLICATIONS

English language translation of Chinese Office Action dated Sep. 19, 2008 issued in counterpart Chinese Appln. No. 200610067905.6.

* cited by examiner

*Primary Examiner*—Bao Q Truong
(74) *Attorney, Agent, or Firm*—Frishauf, Holtz, Goodman & Chick, P.C.

(57) ABSTRACT

A discharge lamp includes a reflector in which a light-emitting tube is housed in an interior of the reflector, and in which a protective glass, provided to cover the open part of the reflector, is fixed to the reflector using a silicone adhesive. A recessed part for suppressing the flow of the silicone adhesive into the reflector interior is provided in the circumferential direction in the reflector front face on which the protective glass is affixed using the silicone adhesive.

12 Claims, 6 Drawing Sheets

[FIG. 1]
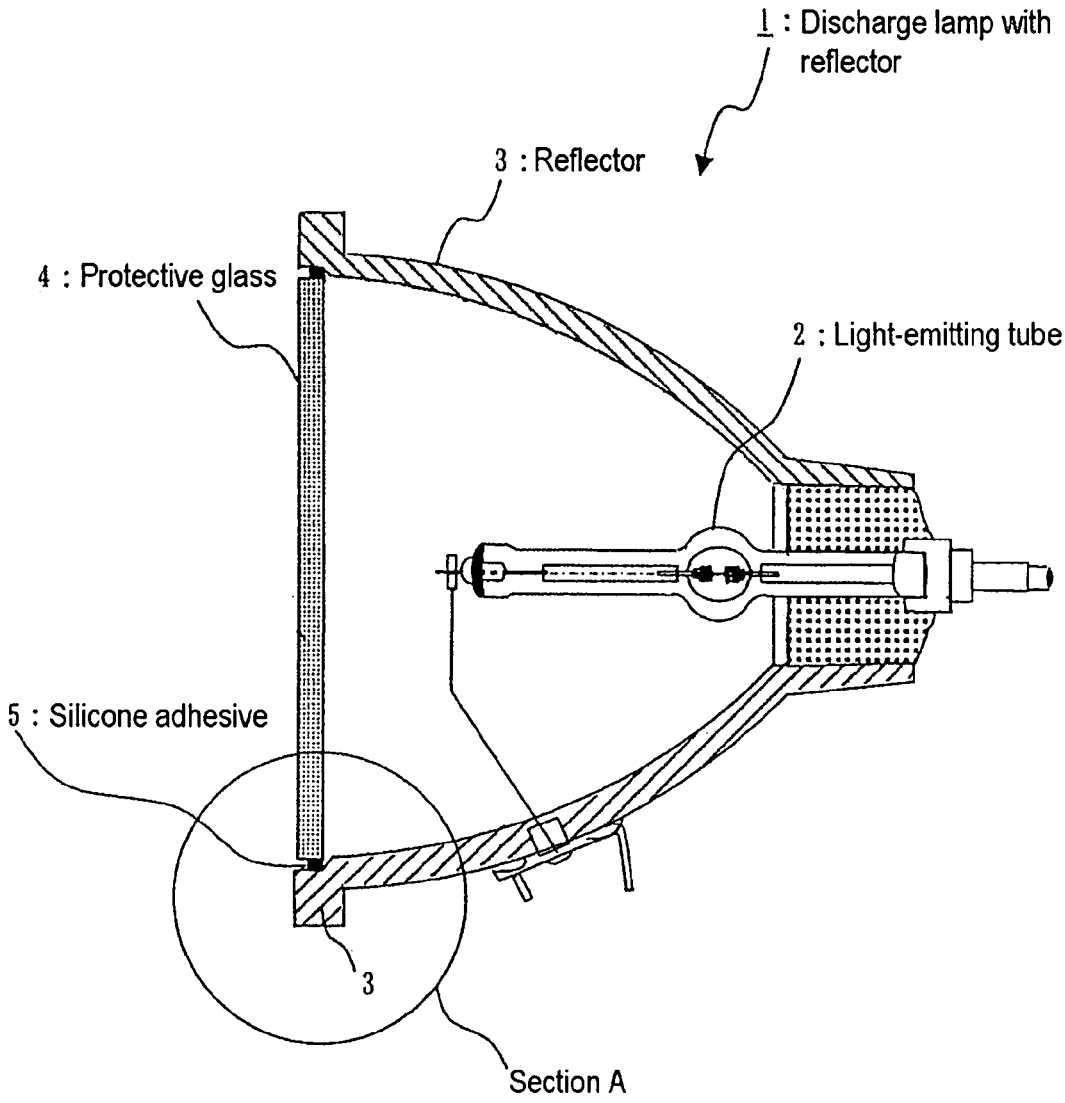

[FIG. 2]
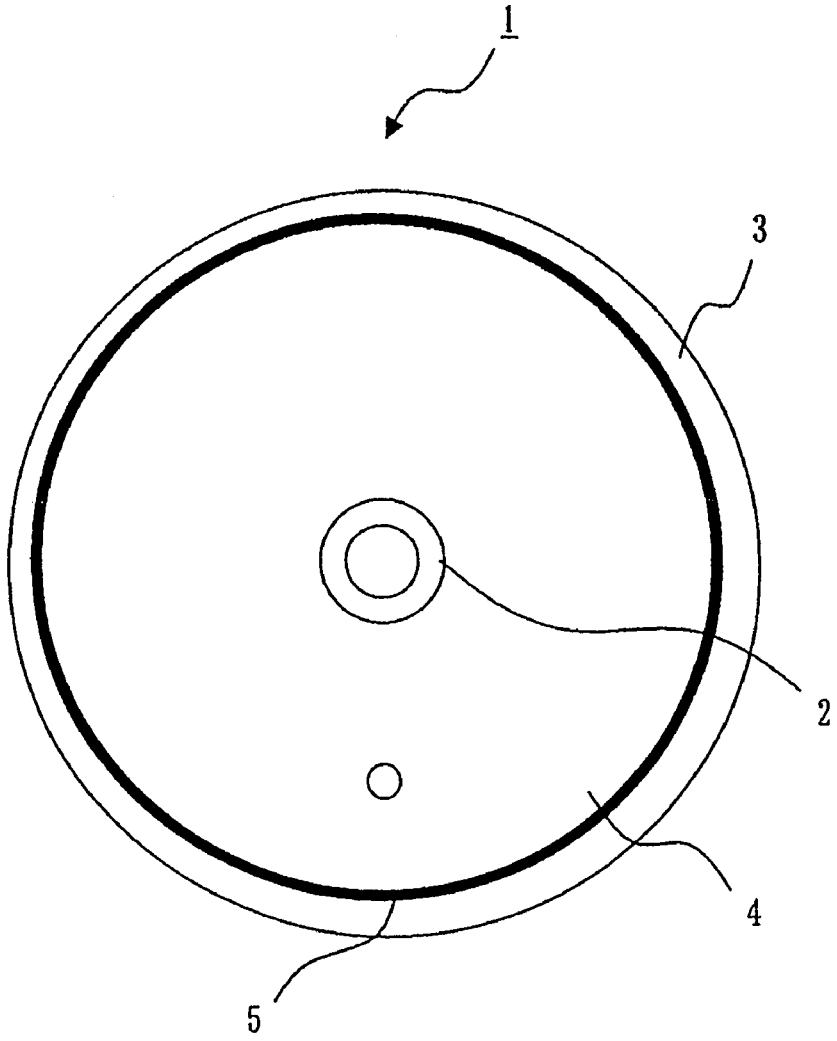
[FIG. 3]
Expanded view of section A of FIG. 1 (reflector 3 only)
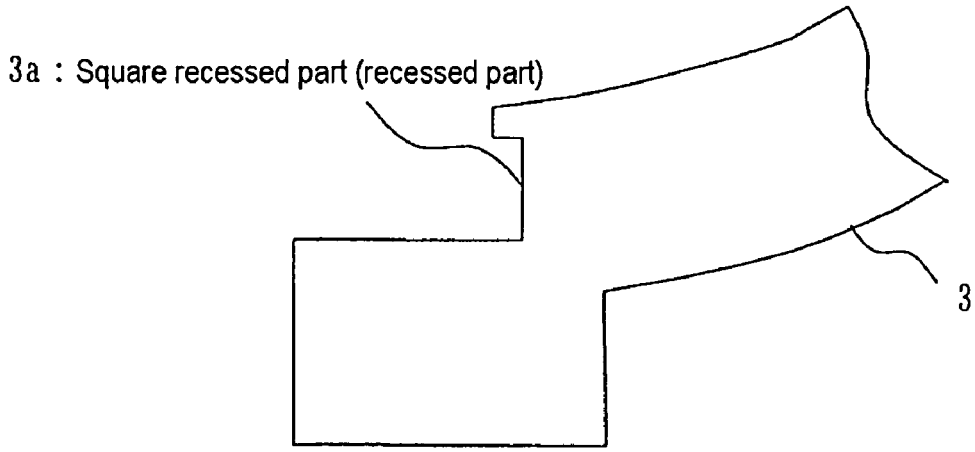

[FIG. 4]
Detail diagram of section A of FIG. 1
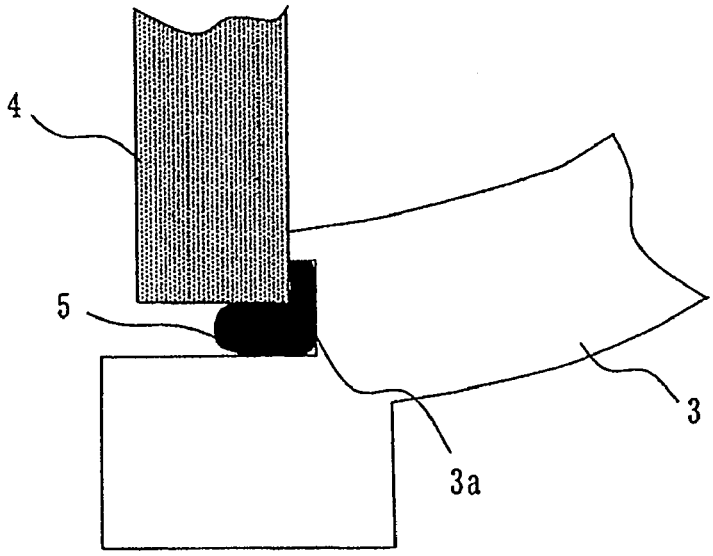
[FIG. 5]
3b : Circular recessed part (recessed part)
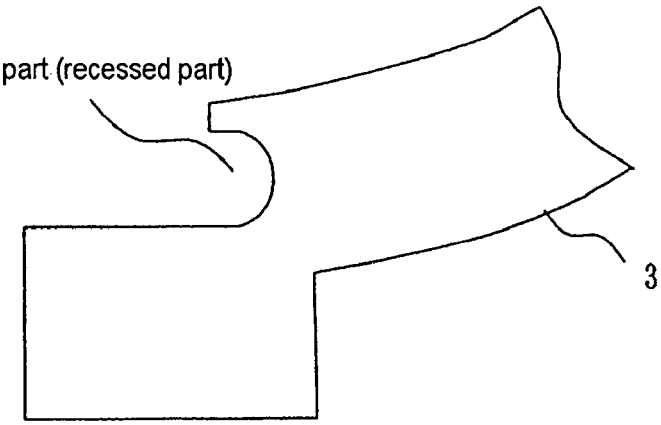
[FIG. 6]
3c : Trapezoidal recessed part (recessed part)
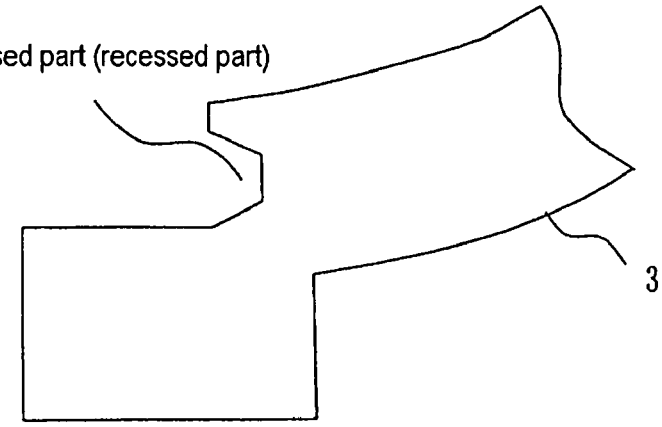

[FIG. 7]
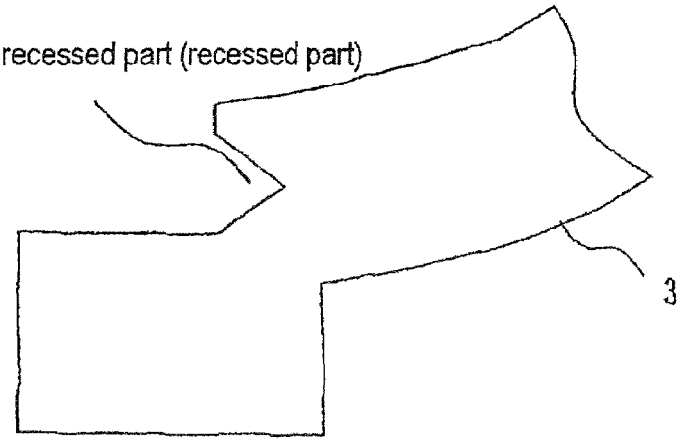
[FIG. 8]
PRIOR ART
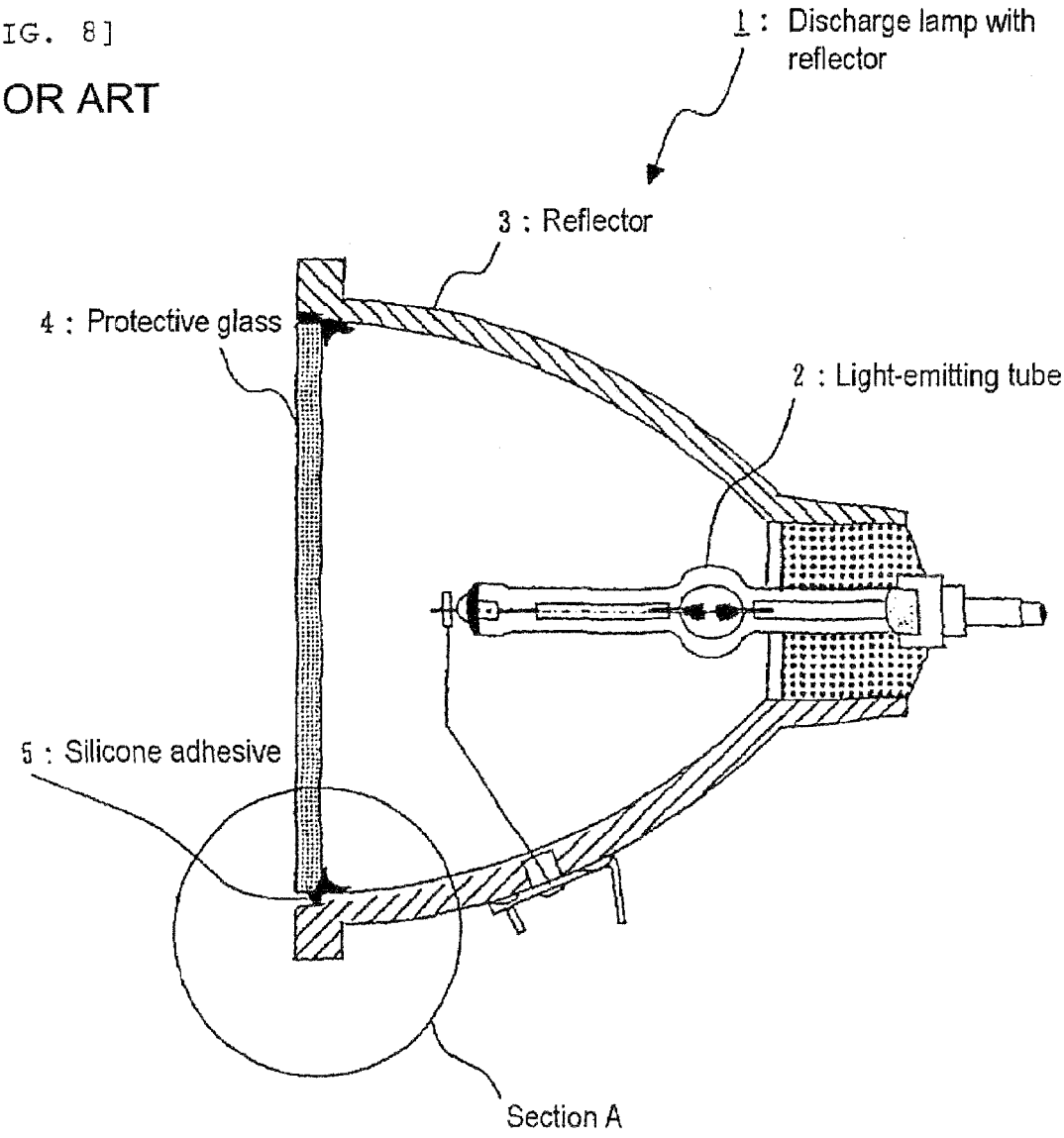

[FIG. 9]
PRIOR ART
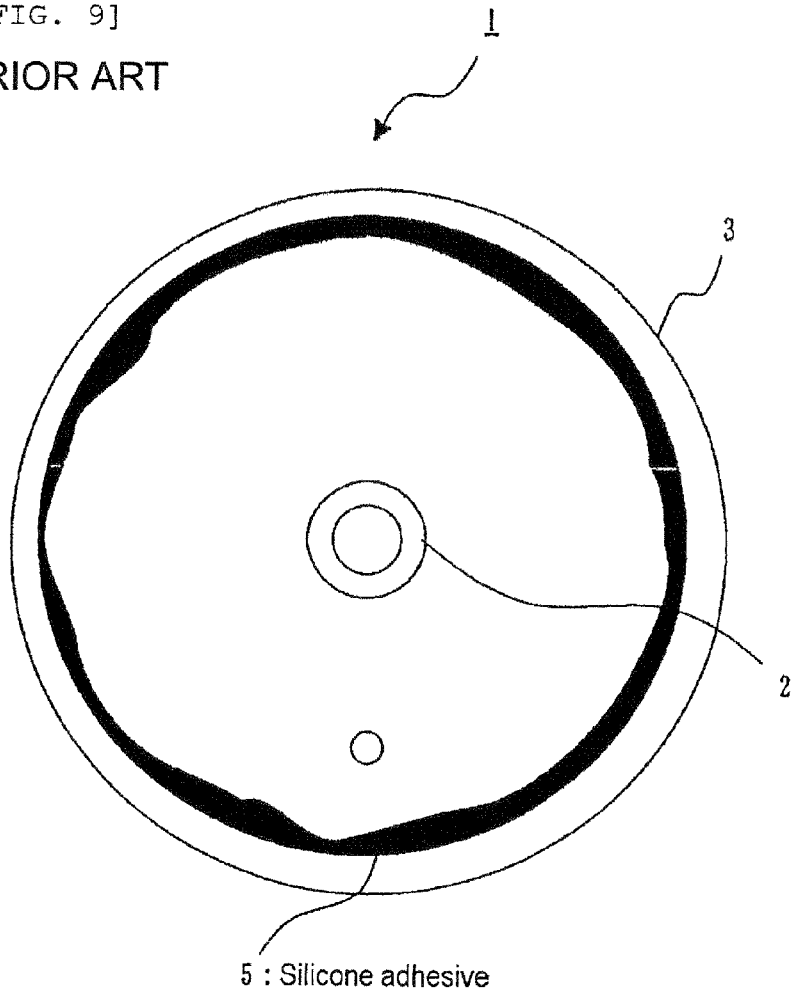
[FIG. 10]
PRIOR ART
Expanded view of section A of FIG. 9 (reflector 3 only)
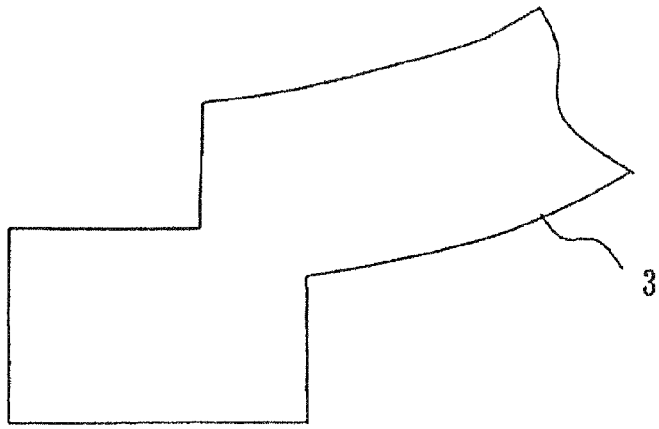

[FIG. 11]
PRIOR ART
Expanded view of section A of FIG. 9
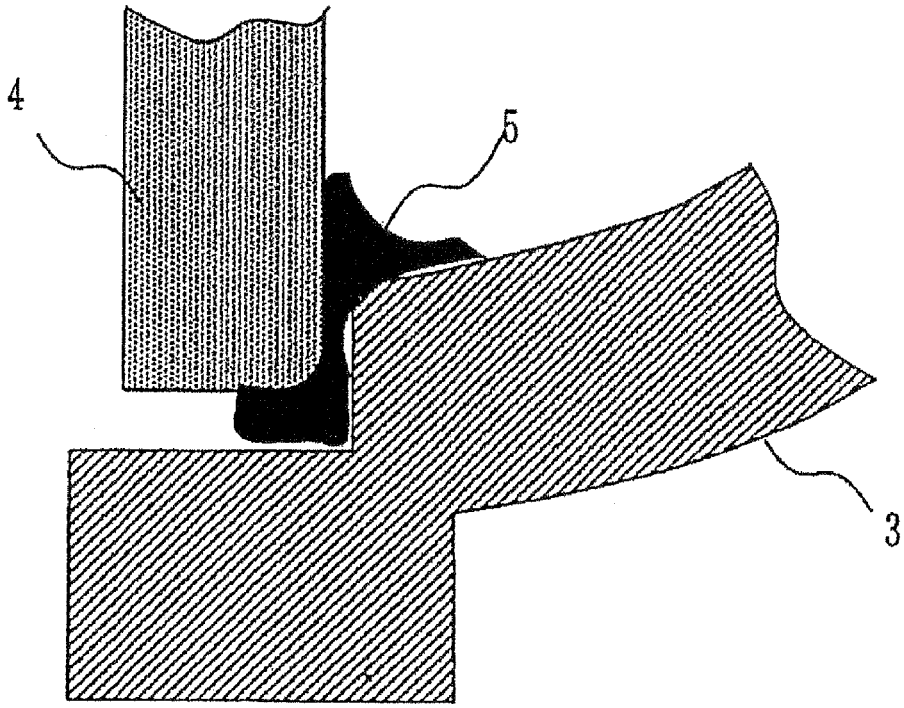

DISCHARGE LAMP WITH REFLECTOR

TECHNICAL FIELD

The invention relates to a discharge lamp with reflector employed as a light source for a projector as described in the precharacteristing part of claim 1.

BACKGROUND ART

FIGS. 8 and 9 show an example of a discharge lamp with reflector of the prior art, for example Japanese Unexamined Patent Application No.2002-319310. The light-emitting component of a light-emitting tube 2 of a discharge lamp with reflector 1 is located at the focal point of the reflector 3, and the irradiated light reflected by a reflector film coated on the interior surface of the reflector 3 is irradiated to the front of the lamp. The irradiated incident light falls on an optical system provided in front of the lamp. A protective glass 4 affixed to the front surface of the reflector 3 protects against the scattering of glass fragments to the exterior should the light-emitting tube 2 break. The protective glass 4 is fixed to the reflector 3 using a silicone adhesive 5.

DISCLOSURE OF THE INVENTION

It is an object of the present invention to create a discharge lamp as described in the precharacteristing part of claim 1 which avoids the disadvantages of the prior art. As shown in FIG. 11, in the discharge lamp with reflector 1 of the prior art the silicone adhesive 5 used for the fixing of the protective glass 4 flows out and attaches to the interior surface of the reflector 3. This is because, as shown in FIG. 10, the bonding surface between the protective glass 4 and the reflector 3 is a flat surface and there is nothing to prevent the silicone adhesive 5 from diffusing on to the interior surface of the reflector 3.

The lighting of the lamp causes the temperature of the silicone adhesive 5 that has flowed into the interior surface of the reflector 3 to rise. As a result, the low molecular weight siloxane contained in the silicone adhesive 5 volatilizes and subsequently attaches to and causes clouding on the interior surface of the reflector 3. The resultant problems are a reduction in the reflectance of the interior surface of the reflector 3 and a reduction in the light irradiated to the front of the lamp.

An object of the invention, which is designed to resolve these problems, is to provide a discharge lamp with reflector in which there is little fear that a clouding of the interior surface of the reflector will occur as a result of the flow of silicone adhesive on to the interior surface of the reflector.

This object is achieved by the characterizing features of claim 1. Particularly advantageous refinements will be found in the dependent claims. In the discharge lamp with reflector pertaining to the this invention, which constitutes a discharge lamp with reflector in which a light-emitting tube is housed in the reflector interior, and in which a protective glass, provided in such a way as to cover the front face open part of the abovementioned reflector, is fixed to the abovementioned reflector using a silicone adhesive, a recessed part for suppressing the flow of the abovementioned silicone adhesive into the abovementioned reflector interior is provided in the circumferential direction in the surface of the abovementioned reflector front face on which the abovementioned protective glass is affixed using said silicone adhesive.

In the discharge lamp with reflector pertaining to this invention of the configuration described above there is little fear that a clouding of the interior surface of the reflector will occur as a result of the flow of silicone adhesive on to the interior surface of the reflector.

BRIEF DESCRIPTION OF THE DRAWINGS

[FIG. 1] is a cross-sectional view of a discharge lamp with reflector of embodiment 1 of the invention;

[FIG. 2] is a front view of the discharge lamp with reflector of embodiment 1 of the invention;

[FIG. 3] is an expanded view of section A of FIG. 1 (reflector only);

[FIG. 4] is a detail diagram of section A of FIG. 1;

[FIG. 5] is a diagram of a modified example of the reflector recessed part of embodiment 1 of the invention;

[FIG. 6] is a diagram of a modified example of the reflector recessed part of embodiment 1 of the invention;

[FIG. 7] is a diagram of a modified example of the reflector recessed part of embodiment 1 of the invention

[FIG. 8] is a cross-sectional view of a discharge lamp with reflector of the prior art;

[FIG. 9] is a front view of a discharge lamp with reflector of the prior art;

[FIG. 10] is an expanded view of section A of FIG. 9 (reflector only); and

[FIG. 11] is a detail diagram of section A of FIG. 9.

BEST MODE FOR CARRYING OUT THE INVENTION

FIGS. 1 to 7 represent diagrams of embodiment mode 1. FIG. 1 is a cross-sectional view of a discharge lamp with reflector, FIG. 2 is a front view of the discharge lamp with reflector, FIG. 3 is an expanded view of section A of FIG. 1 (reflector only), FIG. 4 is a detail diagram of section A of FIG. 1, and FIGS. 5 to 7 are diagrams of modified examples of the recessed part of the reflector. In FIGS. 1 and 2, an Embodiment mode is shown. The light-emitting component of a light-emitting tube 2 of a discharge lamp with reflector 1 is located at the focal point of the reflector 3, and the irradiated light reflected by a reflector film coated on the interior surface of the reflector 3 is irradiated to the front of the lamp. The irradiated incident light falls on an optical system provided in front of the lamp. A protective glass 4 affixed to the front surface of the reflector 3 protects against the scattering of glass fragments to the exterior should the light-emitting tube 2 break. The protective glass 4 is fixed to the reflector 3 using a silicone adhesive 5.

The silicone adhesive 5 contains low molecular weight siloxane. The low molecular weight siloxane is volatile and, when it flows on to the reflector interior 3, it attaches to and causes clouding on the interior surface of the reflector 3. Because, as a result, a reduction in the reflectance of the interior surface of the reflector 3 and a reduction in the light irradiated to the front of the lamp occurs, it is essential to prevent the flow of the silicone adhesive 5 into the reflector interior 3.

For this reason, as shown in FIG. 3, a recessed part 3*a* (as one example of a recessed part) in which the silicone adhesive 5 is held to prevent it from flowing into the reflector 3 interior is provided in the circumferential direction in the surface of the reflector 3 front face on which the protective glass 4 is affixed. Although the provision of a recessed part in the circumferential direction across the entire surface thereof is desirable, it is not mandatory. FIG. 3 also shows the side face of the reflector 3 which, as shown in FIG. 4, faces the side face of the protective glass 4, and the front face of the reflector 3 having the recessed part 3*a* facing the rear face of the protective glass 4. Also, as shown in FIG. 3, the recessed part 3*a* is contiquous with the side face of the reflector 3.

As shown in FIG. 4, the flow of the silicone adhesive 5 into the reflector 3 interior can be suppressed by the adoption of a configuration such as this.

Although a square recessed part 3*a* is shown in FIG. 3, as shown in FIGS. 5 to 7 the recessed part may be of any shape including a circular recessed part 3*b*, a trapezoidal recessed part 3*c* or a triangular recessed part 3*d*.

As is clear from the description given above, based on this embodiment, the flow of the silicone adhesive into the reflector 3 interior can be controlled by the provision in the surface on which the protective glass 4 of the reflector 3 front face is affixed of a square recessed part 3*a*, a circular recessed part 3*b*, a trapezoidal recessed part 3*c* or a triangular recessed part 3*d* in such a way as to hold the silicone adhesive 5 and prevent its flow into the reflector 3 interior, whereupon the volatilization of the low molecular weight siloxane of the silicone adhesive 5, which causes clouding on the interior surface of the reflector 3, can be prevented. Accordingly, there is little fear that a reduction in the reflectance of the interior surface of the reflector 3 or a reduction in the light irradiated to the front of the lamp will occur.

Explanation of Symbols

1 Discharge lamp with reflector, 2 Light-emitting tube, 3 Reflector, 3*a* Square recessed part, 3*b* Circular recessed part, 3*c* Trapezoidal recessed part, 3*d* Triangular recessed part, 4 Protective glass, 5 Silicone adhesive.

The invention claimed is:

1. A discharge lamp comprising:

a reflector defining an interior and having an open part leading to the interior and a front face around the open part, a light-emitting tube housed in the interior of the reflector, and a planar protective part covering the open part of the reflector, wherein the protective part is fixed to the front face of the reflector by an adhesive and has a rear face facing the interior of the reflector, wherein the front face of the reflector faces the rear face of the protective part and includes a circumferential step having a recessed part arranged in a circumferential direction of the front face to suppress flow of the adhesive into the interior of the reflector, and wherein the protective part comprises an outermost side face facing a side face of the circumferential step, and the protective part is insertable into the circumferential step to be surrounded thereby.

2. The discharge lamp according to claim 1, wherein the recessed part has a square cross-section.

3. The discharge lamp according to claim 1, wherein the recessed part has a circular cross-section.

4. The discharge lamp according to claim 1, wherein the recessed part has a trapezoidal cross-section.

5. The discharge lamp according to claim 1, wherein the recessed part has a triangular cross-section.

6. The discharge lamp according to claim 1, wherein the protective part is made of glass.

7. The discharge lamp according to claim 1, wherein the adhesive is a silicone adhesive.

8. The discharge lamp according to claim 1, wherein the protective part is affixed onto a surface of the front face of the reflector by the adhesive.

9. The discharge lamp according to claim 1, wherein the recessed part is arranged to hold the adhesive and prevent the adhesive from flowing into the interior of the reflector defined by the rear face of the protective part and an interior surface of the reflector.

10. The discharge lamp according to claim 1, wherein the recessed part is arranged in the circumferential direction across an entire surface of the front face.

11. The discharge lamp according to claim 1, wherein the circumferential step includes a projecting portion alongside and radially inward of the recessed part, and the projecting portion projects less than the side face of the circumferential step such that a rear face of the protective part extends over the recessed part and the projecting portion.

12. The discharge lamp according to claim 1, wherein the side face of the circumferential step is contiguous with the recessed part.

* * * * *